United States Patent [19]

Davis

[11] Patent Number: 4,611,265

[45] Date of Patent: Sep. 9, 1986

[54] LIGHTED ADDRESS DISPLAY WITH EMERGENCY SIGNAL SYSTEM

[76] Inventor: Dennis G. Davis, 4428 S. 348th Pl., Auburn, Wash. 98001

[21] Appl. No.: 642,169

[22] Filed: Aug. 20, 1984

[51] Int. Cl.[4] ..... F21S 1/14

[52] U.S. Cl. ..... 362/145; 362/243; 362/247; 362/276; 362/296; 362/375; 362/812; 40/552; 40/553

[58] Field of Search ..... 362/145, 147, 276, 812, 362/242, 243, 247, 375; 40/552, 553

[56] References Cited

U.S. PATENT DOCUMENTS

| | | | |
|---|---|---|---|
| 3,113,293 | 12/1963 | Breese et al. | 362/812 X |
| 4,254,405 | 3/1981 | Wenzlaff | 362/362 X |
| 4,254,457 | 3/1981 | Lordier | 362/812 X |
| 4,432,041 | 2/1984 | Pfisterer et al. | 362/276 X |
| 4,435,743 | 3/1984 | Plumly | 362/276 X |
| 4,441,143 | 4/1984 | Richardson, Jr. | 362/147 X |
| 4,450,351 | 5/1984 | Fraden | 362/276 X |

*Primary Examiner*—Peter A. Nelson
*Attorney, Agent, or Firm*—Delbert J. Barnard

[57] ABSTRACT

An emergency light (48) is mounted within a central rear portion of a housing (12). The emergency (48) is positioned closely adjacent the central portion of a planar reflective surface (52) which is parallel to a translucent wall (30) of the housing (12) on which address indicia appears. The housing (12) also includes a light (44) which is turned on when it becomes dark, and which stays on to illuminate the address. A remote control circuit is provided for the emergency light (48) so that the light can be turned on by a person inside of a house or building on in front of which the lighted address display is located, so that such person can signal to a neighbor or a passer-by that help is needed in the house or building, or that an intruder is inside the house or building.

4 Claims, 5 Drawing Figures

1320
10
12
14
16
18
20
22
24
26
28
30
32
34
36
38
40
42
44
46
48
50
52

LIGHTED ADDRESS DISPLAY WITH EMERGENCY SIGNAL SYSTEM

TECHNICAL FIELD

The present invention relates to lighted address displays. More particularly, it relates to the provision of a lighted address display which also can function as an emergency signal for use by persons within a house or building for signaling to neighbors or passers-by that someone in the house requires assistance, or that an intruder is within the house.

BACKGROUND ART

Lighted address displays are well-known. Some exist in the form of lighting fixtures which are recessed into a wall portion of a house, presenting a translucent panel substantially flush with the side of the house on which address indicia appears. Others exist in the form of boxes which are mounted onto an exterior wall of the house or building, or onto a post out in front of the house or building.

These known lighted address displays are basically characterized by an address display, a light bulb positioned behind the address display, and circuit means connecting the light bulb to electrical energy. The circuit includes an off-on switch and quite often the switch is a photo cell which operates automatically to turn the light on when it becomes dark and turn it off when it becomes light.

DISCLOSURE OF THE INVENTION

The principal object of the present invention is to provide a lighted address display with an emergency signal light which can be turned on day or night and which can be used by a person inside of the house or building on or in front of which the address display is located to signal a neighbor or a passer-by that assistance is needed within the house or building, or that an intruder is inside the building.

According to a basic aspect of the invention, a flashing emergency light is positioned behind a translucent wall of the address display. The flashing emergency light is remotely controlled by a person or condition inside the house or building.

The mechanism of this invention is kept simple and inexpensive by the use of a simple reflector in combination with the emergency light. In preferred form, the emergency light comprises a small size light bulb which is positioned immediately forwardly of the central portion of a planar reflective surface. The planar reflective surface is positioned to reflect light toward the translucent wall.

It was found that the close placement of the light to the central portion of the reflective surface, and the location of the reflective surface at the back wall of the compartment in which the light is housed, makes it possible to reflect most of the light which is emitted rearwardly, forwardly to the translucent wall by use of a reflective surface which is about the length of the center third portion of the back wall of the compartment.

The signal device may be used by an invalid or an elderly person inside of the house, requiring medical attention or some other type of help. Also, it can be used to signal that an intruder has come into the house. Thus, it may be a part of a burglar or intruder alarm system, in which case it may be turned on by an intruder activated switch.

Further the invention involves other features which are described in the description of the preferred embodiment which are particularly pointed out and distinctly claimed in the appended claims. Accordingly, the description of the preferred embodiment and the claims are also parts of the description of the invention.

BRIEF DESCRIPTION OF THE DRAWING

In the drawing, like reference characters refer to like parts throughout, and.

BEST MODE FOR CARRYING OUT THE INVENTION

Figures 1, 2, 3:
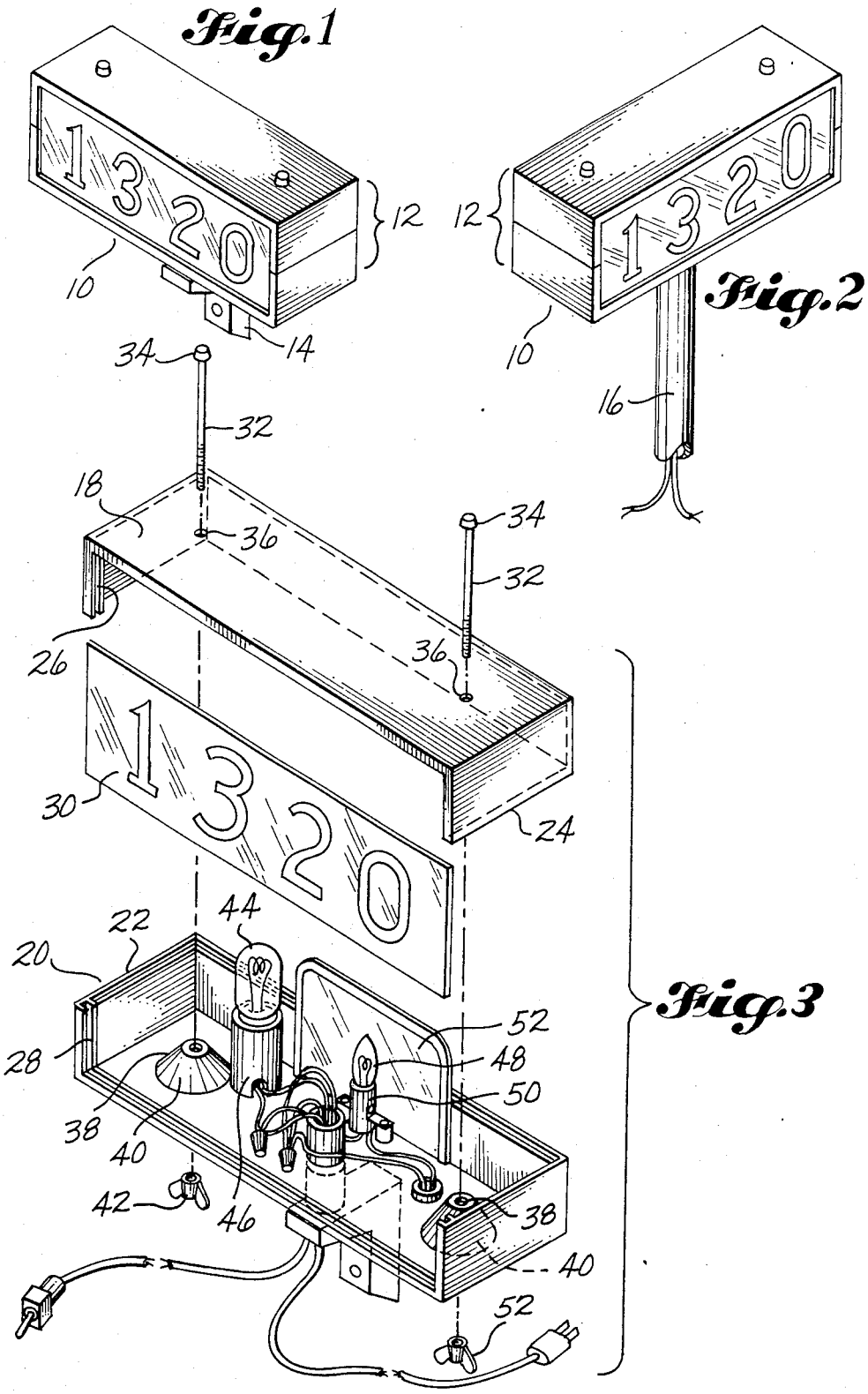
FIG. 1 is a pictorial view of a lighted address display for a house or building, taken from above and looking toward the address side and one end thereof, said display being of a type having a mounting bracket for connecting it to the sidewall of the house or building.
FIG. 2 is a view similar to FIG. 1, but from a different angle and showing the lighted address display mounted on top of a post.
FIG. 3 is an exploded pictorial view of the address display shown by FIG. 1.

FIG. 1 shows a lighted address display 10 comprising a two part housing 12 and a mounting bracket 14 for use in mounting the housing 12 onto the side surface of a building structure.

The housing 12 is a standard housing of a type that has been used for many years. It is not a part of the present invention.

FIG. 2 shows the same type of lighted address display mounted onto the top of a support post or pipe 16. This arrangement is used if it is desired to mount the lighted address display 10 away from the house, e.g. alongside the driveway close to the street.

FIG. 3 shows that the housing 12 may comprise an upper part 18 and a lower part 20 having interfitting edges 22, 24 at the ends and the backside of the housing 12. The front portions of the housing parts 18, 20 are formed to define upper and lower channels 26, 28 for receiving edge portions of a translucent front wall 30.

The housing parts 18, 20 may be secured together by a pair of long bolts 32 having heads 34 at their upper ends. The bolts 34 are inserted downwardly through openings 36 in the upper wall of the top housing part 18. The lower ends of the bolts 32 extend through openings 38 formed in the bottom wall of the lower housing part 20. The bottom wall of lower housing part 20 may be formed to include upwardly projecting bosses 40 which taper toward the bolt openings 38. This is done to provide recesses below housing part 20 into which the lower ends of the bolts 32 extend, and in which a pair of wing nuts 42 are partially housed. The wing nuts are screwed onto the lower ends of the bolts 32.

A conventional lighted address display includes a single low watt light bulb that is connected to electricity by a quite simple circuit which includes a manual off-on switch or a photo cell type off-on switch.

The lighted address display of the present invention includes a standard low wattage light bulb 44 which screws into a base 46 which may be mounted onto the bottom of the lower housing part 20 in the manner and in the position shown by FIG. 3.

Figure 5:
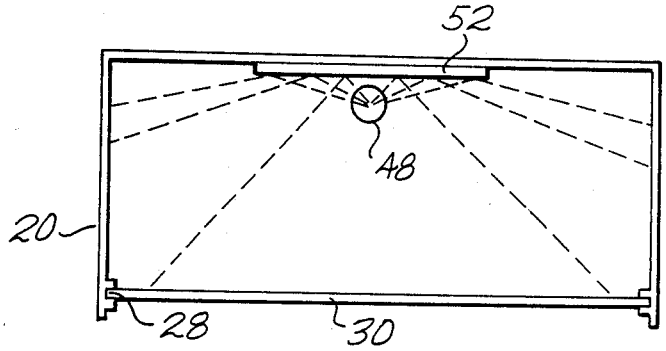
FIG. 5 is a top plan view looking down into a lower housing portion of the address display, showing the relationship of an emergency light and a reflector to the sidewalls of the housing and a translucent wall at the front of the housing.

In accordance with the present invention, a second emergency light 48 is mounted within the housing, preferably at a central rear position, as shown by FIGS. 3 and 5. The emergency light comprises a light bulb 48 which screws into a support socket 50 which may also be secured to the bottom of the lower housing part 20. A reflector 52 is positioned behind the light bulb 48. Preferably, reflector 52 is planar and the bulb 48 is located closely adjacent its center. As shown by FIG. 5, this placement of the bulb 48 results in a forward reflection of most of the light rays which emit from bulb 48 toward the rear of the housing part 20, even with the use of a reflector 52 which has a length that is only about one-third the length of the rear wall of the lower housing part 20. This arrangement makes it possible to use a relatively small light bulb 48 and yet produce a substantially bright, attention getting light when the light bulb 48 is on and signaling an emergency condition.

In preferred form, the panel 30 is constructed from a translucent white plastic material. The address numerals are opaque stick-on numerals.

Figure 4:
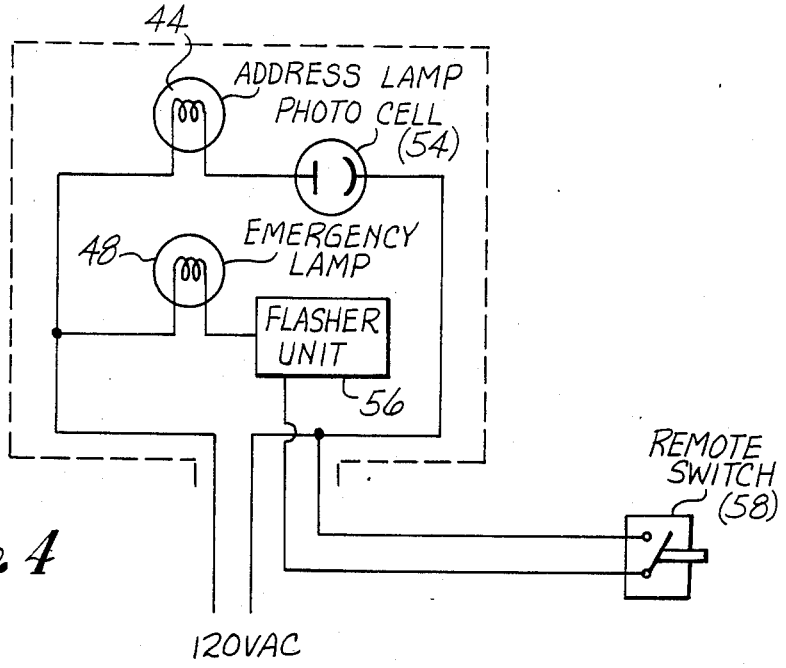
FIG. 4 is a circuit diagram for the address display.

Referring to FIG. 4, the standard address lighting lamp or bulb 44 is shown to be in series with a standard photo cell type on-off switch 54 in a 120 volt alternating current circuit. The emergency light bulb or lamp 48 is shown in parallel with light bulb 44, and in series with a flasher unit 56 and a remote control switch 58. A flasher unit is a standard, readily available component which acts as a switch which automatically turns on and off, causing the light 48 to flash on every time it is on.

Remote switch 48 is shown in the form of a manual switch 58. In a typical installation, the house or building may be wired to provide a plurality of manual switches in different parts of the house or building.

Or, the wired switch 58 may be replaced by a wireless switch.

One group of persons who would have a use for this invention are shut-ins. For these people a switch would be provided at each of the stations which they would occupy during the course of the day. One would be provided at the person's bed. Another would be provided in a sitting room for such person.

It is desired that a light bulb 48 be used which will provide a strong light. This type of light bulb in combination with the reflector 52, and the close placement of the bulb 48 to the reflector, at the rear of the housing, results in a quite bright, attention grabbing signal being produced at the front panel 30 when the emergency light is on.

It might be desired to construct a lighted address display which has two sides on which the address appears. Such a display could be easily made by duplicating what is shown in FIGS. 3–5 on opposite sides of a vertical center wall. In other words, the vertical center wall would divide the housing into two compartments, and the outer wall of each compartment would be a panel 30 on which the address indicia appears.

It will readily apparent to those skilled in the art that many modifications can be made to the apparatus which has been disclosed and described, without departing from the invention that is defined by the appended claims.

What is claimed is:

1. A combined address display and emergency signaling means for use on a house or building, comprising:

a housing having an exterior sidewall of translucent material on which address indicia appears;

a light source inside of said housing for lighting the translucent material, to display the address indicia; and an emergency signaling means including a flashing emergency light means within the housing, reflector means behind said emergency light means, positioned to reflect light towards the translucent wall, and a control circuit means operable by a person or condition inside of the house or building, for turning on the emergency light, to cause the address display to flash on and off so that a neighbor or passerby, etc. can see that help is needed inside of the house or building, said emergency signaling means comprising a light bulb mounted within the housing in a position spaced inwardly of the housing from a central portion of the translucent panel, said reflector means comprising a substantially planar reflecting surface of such an area that a majority of the light emitted towards the reflector means side of the light bulb strikes the reflecting surface, said reflector means being positioned substantially immediately behind the light bulb, and said light bulb being positioned closely adjacent the center of said reflective surface, both horizontally and vertically.

2. A combined address display and emergency signaling means according to claim 1, comprising a continuously on second light bulb within said housing, for illuminating the address indicia, and photo cell switch means for turning such second light bulb on in response to sundown caused darkness and off in response to sunlight.

3. A combined address display and emergency signaling means according to claim 1, wherein the control circuit means comprises switch means inside the house or building, operable by a person for turning emergency signaling means on and off.

4. A combined address display and emergency signaling means according to claim 1, wherein said housing has rectangular proportions, wherein the sidewall of translucent material on which address indicia appears is generally planar, wherein the reflector is offset inwardly of the housing from the sidewall translucent material, and is generally centered with respect to said sidewall of translucent material.

* * * * *